US008546714B2

(12) United States Patent
Zhang et al.

(10) Patent No.: US 8,546,714 B2
(45) Date of Patent: Oct. 1, 2013

(54) BUTTON ASSEMBLY AND ELECTRONIC DEVICE HAVING THE SAME

(75) Inventors: Meng Zhang, Shenzhen (CN); Guang-Yao Lee, New Taipei (TW); Chien-Li Tsai, New Taipei (TW); Jing-Mao Li, Shenzhen (CN); Jie Zhang, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 149 days.

(21) Appl. No.: 13/235,447

(22) Filed: Sep. 18, 2011

(65) Prior Publication Data

US 2013/0020185 A1 Jan. 24, 2013

(30) Foreign Application Priority Data

Jul. 22, 2011 (CN) ..... 2011 1 0206551

(51) Int. Cl.
*H01H 13/50* (2006.01)

(52) U.S. Cl.
USPC ..... 200/344; 200/339; 200/345; 200/296

(58) Field of Classification Search
USPC ..... 200/344, 345
See application file for complete search history.

(56) References Cited

U.S. PATENT DOCUMENTS

| | | | | |
|---|---|---|---|---|
| 5,990,435 | A * | 11/1999 | Chao | 200/517 |
| 6,057,522 | A * | 5/2000 | Chao | 200/344 |
| 7,462,796 | B1 * | 12/2008 | Chai | 200/341 |
| 2009/0321241 | A1 * | 12/2009 | Zhen | 200/532 |

* cited by examiner

*Primary Examiner* — Edwin A. Leon
*Assistant Examiner* — Ahmed Saeed
(74) *Attorney, Agent, or Firm* — Altis & Wispro Law Group, Inc.

(57) ABSTRACT

An electronic device includes a panel, a button assembly, and a circuit board. The panel defines an opening. The button assembly is mounted to the rear surface of the panel, and includes a button partially received in the opening of the panel, a base plate fixed to the rear side of the button, and a substantially U-shaped balance bar. The button includes a push portion and two protrusions rearwards extending through the base plate. An end of the balance bar is movably connected to the rear side of the base plate, and an opposite end of the balance bar is pivotably connected to the protrusions of the button. The circuit board is fixed behind the button assembly, and includes a switch aligning with the push portion of the button. When the button is pressed, the balance bar restricts the button to just move linearly to the switch.

12 Claims, 5 Drawing Sheets

BUTTON ASSEMBLY AND ELECTRONIC DEVICE HAVING THE SAME

BACKGROUND

1. Technical Field

The present disclosure relates to an electronic device having a button assembly.

2. Description of Related Art

An electronic device generally includes a button, such as a power button. However, if a button is too long, it can become tilted when pressed, and not properly press a switch it is supposedly activate or deactivate.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawing, all the views are schematic, and like reference numerals designate corresponding parts throughout the several views.

DETAILED DESCRIPTION

The disclosure, including the accompanying drawings, is illustrated by way of example and not by way of limitation. It should be noted that references to "an" or "one" embodiment in this disclosure are not necessarily to the same embodiment, and such references mean at least one.

Figure 1:
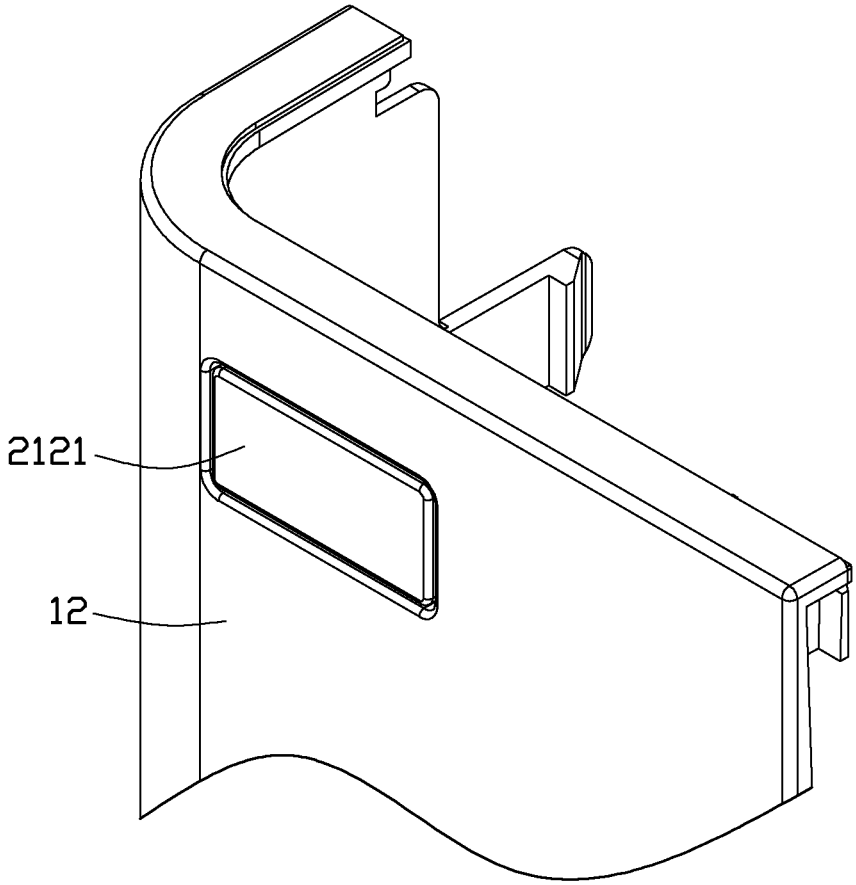
FIG. 1 is a partial, assembled, isometric view of an exemplary embodiment of an electronic device.
Figure 2:
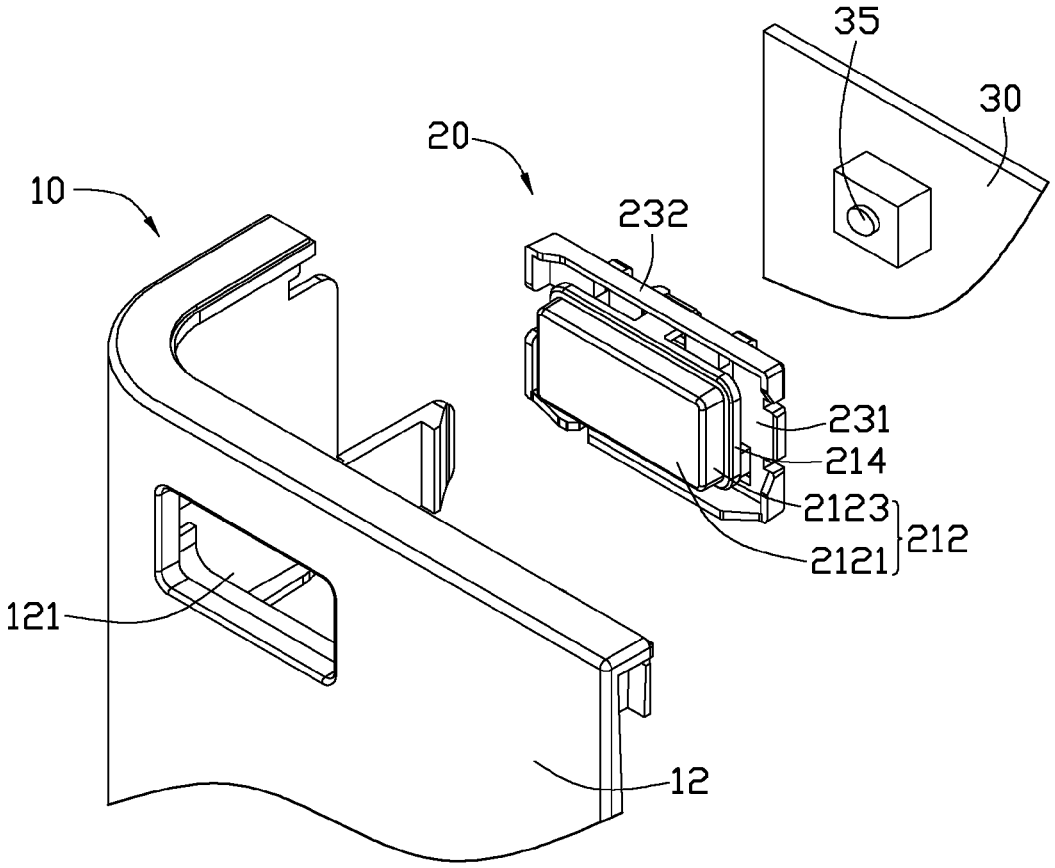
FIG. 2 is an exploded, isometric view of FIG. 1, wherein the electronic device includes a panel, a button assembly, and a circuit board.
Figure 3:
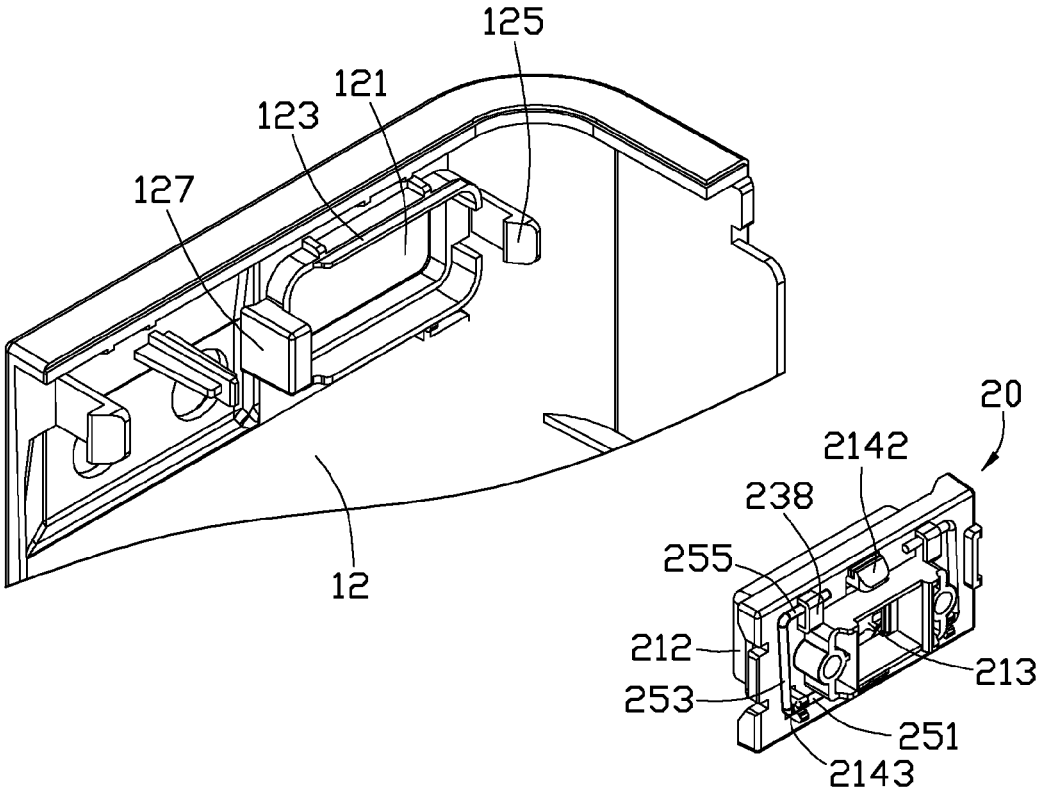
FIG. 3 is a reversed view of the panel and the button assembly of FIG. 2.

Referring to FIGS. 1 to 3, an exemplary embodiment of an electronic device includes an enclosure 10, a button assembly 20, and a circuit board 30 forming a switch 35 thereon.

The enclosure 10 includes a panel 12. A substantially rectangular opening 121 is defined in the panel 12. Two flanges 123 extend rearwards from portions of the rear side of the panel 12 respectively above and below the opening 121, and two latches extend rearwards from portions of the rear side of the panel 12 respectively adjacent to two opposite ends of the opening 121. One of the latches includes a hook 125 extending towards the opening 121 from a distal end of the latch. The other latch is a block 127. A slot (not shown) is defined in a side of the block 127 facing the hook 125.

Figure 4:
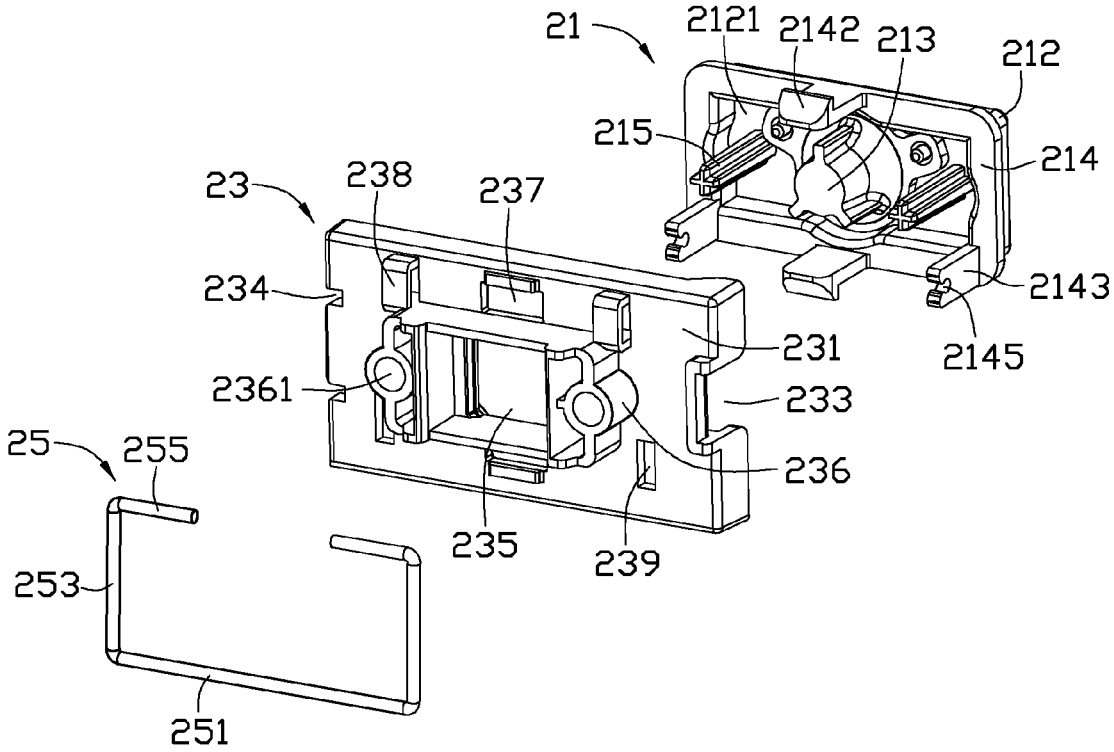
FIG. 4 is an exploded, isometric view of the button assembly of FIG. 3, but viewed from another perspective.

Referring to FIGS. 2 and 4, the button assembly 20 includes a button 21, a base plate 23, and a balance bar 25.

The button 21 includes a main body 212. The main body 212 includes a substantially rectangular press plate 2121, and a sidewall 2123 extending rearwards around the perimeter of the press plate 2121. A rim 214 extends outwards from the rear end of the sidewall 2123 surrounding the main body 212. A push portion 213 protrudes from a middle of the rear surface of the press plate 2121, and two poles 215 extend from the rear surface of the press plate 2121 at opposite sides of the push portion 213, respectively. The rim 214 is parallel to the press plate 2121. Two hooks 2142 extend rearwards from middles of the upper and lower portions of the rear surface of the rim 214, respectively. Two protrusions 2143 extend rearwards from the lower portion of the rear surface of the rim 214, respectively adjacent to opposite ends of the rim 214. A substantially C-shaped slot 2145 is defined in the rear end of each protrusion 2143, with an opening of the slot 2145 facing rearwards.

The base plate 23 includes a substantially rectangular main plate 231. Two side plates 232 respectively extend forwards from the top and the bottom of the main plate 231. A cutout 233 is defined in a first end of the main plate 231, and two spaced notches 234 are defined in a second end of the main plate 231 opposite to the first end. A through opening 235 is defined in a middle of the main plate 231. Two projections 236 extend rearwards from the rear surface of the main plate 231 at opposite ends of the through opening 235, respectively. A positioning hole 2361 is defined in each projection 236. Two fixing holes 237 are defined in the main plate 231, respectively above and below the through opening 235. Two substantially bridge-shaped latching portions 238 are formed on the upper section of the rear surface of the main plate 231 at opposite ends of the corresponding fixing hole 237, respectively. Two through holes 239 are defined in the lower section of the main plate 231 at opposite ends of the corresponding fixing hole 237, respectively.

The balance bar 25 is substantially U-shaped, and includes a first bar 251, two second bars 253 respectively extending upwards from opposite ends of the first bar 251, and two feet 255 extending toward each other from tops of the second bars 253.

Referring to FIGS. 2 and 3, to assemble the button assembly 20, the button 21 is placed at the front side of the base plate 23. The button 21 is moved towards the base plate 23. The poles 215 are inserted into the corresponding positioning holes 2361. The protrusions 2143 are extended through the corresponding through holes 239 and exposed out of the rear side of the base plate 23. The hooks 2142 are extended through the corresponding fixing holes 237 and engage with the rear surface of the base plate 23. Thereby, the button 21 is fixed to the base plate 23. The push portion 213 is extended through the through opening 235.

The balance bar 25 is placed at the rear side of the base plate 23. The feet 255 are movably engaged in the latching portions 238, respectively. Two portions of the first bar 251 respectively adjacent to the second bars 253 are pivotably engaged in the slots 2145. Thereby, the button assembly 20 is assembled.

Figure 5:
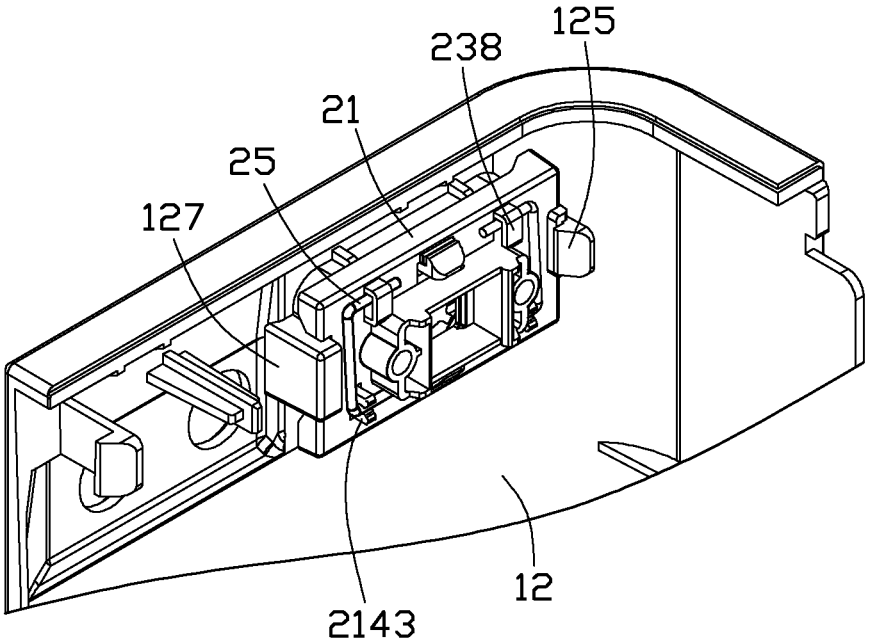
FIG. 5 is an assembled, isometric view of FIG. 3.

Referring to FIG. 5, to assemble the button assembly 20 to the enclosure 10, the button assembly 20 is placed at the rear side of the panel 12. A portion of the base plate 23 between the notches 234 is engaged in the slot of the block 127. The button assembly 20 is moved towards the panel 12, to allow the hook 125 to pass over the cutout 233 and engage with the rear surface of the base plate 23. Thereby, the button assembly 20 is mounted to the panel 12. The main body 212 is received in the opening 121, with the front surface of the press plate 2121 coplanar with the front surface of the panel 12. The rim 214 engages with the rear surface of the panel 12 surrounding the opening 121, and the flanges 123 engage with inner surfaces of the side plates 232, respectively.

The circuit board 30 is installed in the enclosure 10, to allow the switch 35 to be aligned with and spaced from the push portion 213.

In use, no matter which portion of the press plate 2121 is pressed, the balance bar 25 restricts the button 21 to move rearwards linearly, therefore the push portion 213 will correctly press the switch 35. In the exemplary embodiment, the balance bar 25 is movably connected to the rear sides of the button 21 and the base plate 23, and the construction of the button assembly 20 allows the balance bar 25 to slide only a short distance, which can save installation space of the button assembly 20, and more efficiently prevent the button 21 from swinging and being tilted.

Even though numerous characteristics and advantages of the embodiments have been set forth in the foregoing description, together with details of the structure and the functions of the embodiments, the disclosure is illustrative only, and changes may be made in details, especially in matters of shape, size, and arrangement of parts within the principles of the embodiments to the full extent indicated by the broad general meaning of the terms in which the appended claims are expressed.

What is claimed is:

1. A button assembly, comprising:

a button comprising a push portion protruding rearwards from a middle of a rear surface of the button, and two protrusions extending rearwards from a lower portion of the rear surface of the button, the protrusions respectively adjacent to opposite ends of the button;

a base plate fixed to the rear side of the button, wherein the push portion and the protrusions of the button are extended through the base plate, and two latching portions are formed on a rear surface of the base plate above the push portion, respectively adjacent to the opposite ends of the button; and a balance bar comprising a first bar, two second bars respectively extending upwards from opposite ends of the first bar, and two feet respectively extending from tops of the second bars, wherein the feet are movably engaged in the latching portions of the base plate, respectively, and two portions of the first bar respectively adjacent to the second bars are pivotably engaged in the protrusions of the button, respectively;

wherein the button comprises a main body and a rim surrounding a rear end of the main body, the main body comprises a press plate, and a sidewall extending rearwards around the perimeter of the press plate, the rim extends outwards from a rear end of the sidewall, the push portion protrudes rearwards from a rear surface of the press plate, and the protrusions extend rearwards from the lower portion of a rear surface of the rim; and wherein two poles extend rearwards from the rear surface of the press plate respectively at opposite sides of the push portion, two projections extend rearwards from the rear surface of the base plate, and a positioning hole is defined in each of the projections, to receive a corresponding one of the poles of the button.

2. The button assembly of claim 1, wherein a through opening is defined in a middle of the base plate, and two through holes are defined in a lower portion of the base plate, the push portion is extended through the through opening, and the protrusions are extended through the through holes, respectively.

3. The button assembly of claim 2, wherein a substantially C-shaped slot is defined in the rear end of each protrusion, the portions of the first bar respectively adjacent to the second bars are pivotably engaged in the slots of the protrusions of the button, respectively.

4. The button assembly of claim 1, wherein two hooks respectively extend rearwards from middles of upper and lower portions of the rear surface of the rim, two fixing holes are defined in the base plate respectively above and below the through opening, and the hooks are extended through the corresponding fixing holes and engage with the rear surface of the base plate, to fix the button to the base plate.

5. The button assembly of claim 1, wherein the latching portions are substantially bridge-shaped.

6. The button assembly of claim 1, wherein the feet of the balance bar extend toward each other.

7. An electronic device, comprising:

a panel defining an opening;

a button assembly mounted to a rear surface of the panel, the button assembly comprising:

a button partially received in the opening of the panel, and comprising a push portion protruding rearwards from a middle of the button, and two protrusions extending rearwards from a lower portion of the button, the protrusions respectively adjacent to opposite ends of the button;

a base plate fixed to a rear side of the button, wherein the push portion and the protrusions of the button are extended through the base plate, two latching portions are formed on a rear surface of the base plate behind an upper portion of the button; and a substantially U-shaped balance bar, wherein a top of the balance bar is movably engaged in the latching portions of the base plate, and a bottom of the balance bar is pivotably engaged in the protrusions of the button; and a circuit board fixed behind the button assembly, a switch installed on the circuit board and aligning with the push portion of the button, wherein when the button is pressed rearwards, the balance bar restricts the button to move linearly to the switch;

wherein two latches extend rearwards from the rear surface of the panel respectively adjacent to two opposite ends of the opening, to engage with two opposite ends of the base plate of the button assembly.

8. The electronic device of claim 7, wherein the balance bar comprises a first bar, two second bars respectively extending upwards from opposite ends of the first bar, and two feet extending toward each other from tops of the second bars, the feet are movably engaged in the latching portions of the base plate, respectively, and two portions of the first bar respectively adjacent to the second bars are pivotably engaged in the protrusions of the button, respectively.

9. The electronic device of claim 8, wherein button further comprises a main body received in the opening of the panel, the main body comprises a press plate, and a sidewall extending rearwards around the perimeter of the press plate, a rim extends outwards from a rear end of the sidewall, the rim surrounds the main body and engages with the rear surface of the panel, the push portion protrudes rearwards from a rear surface of the press plate, and the protrusions extend rearwards from a lower portion of a rear surface of the rim.

10. The electronic device of claim 9, wherein a substantially C-shaped slot is defined in a rear end of each protrusion, the portions of the first bar respectively adjacent to the second bars are pivotably engaged in the slots of the protrusions of the button, respectively.

11. The electronic device of claim 9, wherein two hooks respectively extend rearwards from middles of upper and lower portions of the rear surface of the rim, two fixing holes are defined in the base plate respectively between the latching portions and between the through holes, the hooks are extended through the corresponding fixing holes and engage with the rear surface of the base plate, to fix the button to the base plate.

12. The electronic device of claim 7, wherein the latching portions are substantially bridge-shaped.

* * * * *